US006076457A

United States Patent [19]

Vallot

[11] Patent Number: 6,076,457

[45] Date of Patent: Jun. 20, 2000

[54] RIGID CONTAINERS FOR TRANSPORTING SACHETS OF BIO-PHARMACEUTICAL FLUID PRODUCTS

[75] Inventor: Bernard Vallot, Marseille, France

[73] Assignee: Stedim, Aubagne, France

[21] Appl. No.: 09/128,929

[22] Filed: Aug. 5, 1998

[30] Foreign Application Priority Data

Jul. 2, 1998 [FR] France ..... 98 08644

[51] Int. Cl.[7] ..... B30B 1/20

[52] U.S. Cl. ..... 100/290; 100/257; 222/103; 222/326

[58] Field of Search ..... 100/289, 290, 100/257; 206/438, 559, 560, 565, 569; 220/250, 251, 559; 222/95, 103, 105, 326

[56] References Cited

U.S. PATENT DOCUMENTS

| | | | |
|---|---|---|---|
| 597,236 | 1/1898 | Charlton et al. | 100/257 |
| 754,297 | 3/1904 | Freysleben | 100/290 |
| 1,161,540 | 11/1915 | Smagel | 100/290 |
| 1,552,754 | 9/1925 | Petersen | 100/290 |
| 3,565,292 | 2/1971 | Jinotti | 222/103 |
| 4,166,537 | 9/1979 | Fortunato | 220/251 |
| 5,100,025 | 3/1992 | McGraw | 222/95 |
| 5,139,169 | 8/1992 | Boyer . | |
| 5,350,080 | 9/1994 | Brown et al. . | |
| 5,361,940 | 11/1994 | Miller et al. | 222/326 |

FOREIGN PATENT DOCUMENTS

| | | |
|---|---|---|
| 539623 | 7/1955 | Belgium . |
| 0167482 | 1/1986 | European Pat. Off. . |
| 932321 | 3/1948 | France . |
| 1131313 | 2/1957 | France . |
| 97/48623 | 12/1997 | WIPO . |

*Primary Examiner*—Stephen F. Gerrity
*Attorney, Agent, or Firm*—Browdy and Neimark

[57] ABSTRACT

A rigid container for transporting flexible sachets of bio-pharmaceutical fluid having a volume of 50 liters or more has a bottom wall and one or more lateral walls. At the top it has a contention plate for the sachet adjustable in height to compress the sachet.

11 Claims, 2 Drawing Sheets

RIGID CONTAINERS FOR TRANSPORTING SACHETS OF BIO-PHARMACEUTICAL FLUID PRODUCTS

BACKGROUND OF THE INVENTION

1. Field of the Invention

The present invention concerns new rigid containers or transporting sachets of bio-pharmaceutical fluid products.

2. Description of the Prior Art

U.S. Pat. No. 5,350,080 describes sachets which can be used for cellular culture media and their rigid transportation container.

The bio-pharmaceuticals industry, understood in the broadest sense, is increasingly using flexible sachets with capacities in the range 20 liters to 2,000 liters and more, in particular bio-compatible sachets, to transport fluids used in the industry, such as culture media, cellular cultures, buffer solutions, artificial nutrient liquids, blood products or derived products such as plasma.

Sometimes the products contained in such sachets are used thousands of kilometers from the place where the sachets were filled. These products are often extremely valuable in financial terms and often extremely valuable in terms of the health of persons because they can be used to manufacture medication for human use, for example. It is therefore essential for such sachets to reach their destination safely, filled with the liquid with which they were initially filled, and free of contamination.

Flexible sachets of the above kind are subject to many kinds of stress during transportation: acceleration, braking, tossing, shaking, vibration, etc and therefore to many forces including shear forces which tend to deteriorate the film from which they are made, especially at sensitive locations such as folds. Consequently these various stresses frequently lead to weakening, rupture of piercing of the sachets.

It must be remembered that sachets of the above kind intended to contain the previously mentioned liquid products and media are by their very nature provided with a number of access ports enabling their content to be filled, drawn off, mixed, etc, for example, and usually with a number of tubes installed at some or all of these access ports. The tubes are themselves often fitted with one or more rigid material devices such as valves, filters or clamps which can contribute to abrasion of the upper part of the sachets when they are transported over long distances. A hole in the top of a sachet can be just as serious as one elsewhere, for example in the situation of transporting sterile contents.

This is why it would be desirable to have a rigid container for transporting sachets of bio-pharmaceutical liquids having a volume of 50 liters or more enabling safe transportation of such liquids over long distances.

A container of the above kind, once its sachet has been removed, should occupy a smaller volume than it occupies during transportation of the sachet, in order to reduce the volume occupied by the container during its return to its source. It must also be simple and cheap to manufacture, without compromising its efficacy.

SUMMARY OF THE INVENTION

This is why the present application concerns a rigid container for flexible sachets for transporting bio-pharmaceutical fluids having a volume of 50 liters or more consisting of a bottom wall, one or more side walls and a sachet contention plate at the top adjustable in height to compress said sachet.

Note that the contention plate has two functions in particular: on the one hand, it presses on the sachet installed in the container to hold it firmly in position and, on the other hand, it protects the top of the sachet from abrasion due to rubbing of connecting members such as tubes, filters and valves fitted to the access ports at the top of the sachet.

The contention plate is adjustable to press more or less strongly on said sachet. Under preferred conditions of use of the invention, this adjustment is continuous.

For example, continuous adjustment can be obtained by means of a pneumatic system, for example using inflatable sachets or mechanical or hydraulic actuators bearing against longitudinal members or a lid fitted to the top of the container, but under preferred conditions of implementation the adjustment is obtained by means of a system of screw actuators. One or more such actuators are provided, preferably three or four actuators.

The above adjustment device advantageously bears on removable longitudinal members that are preferably parallel to the bottom wall of the container. One simple and effective means of installing such longitudinal members is to form slots through which the end of said longitudinal members can be inserted at the top of the container, for example in two opposite lateral walls of a parallelepiped-shape container. Slots of this kind can be provided at different levels so that the same containers can be used for different sachet volumes. Fine adjustment of the contention is then obtained by means of the adjustment system, in particular the continuous adjustment system such as the actuators mentioned above. The shape of the container can vary and in particular it can be cylindrical. In this case, the longitudinal members are advantageously parallel to a diameter. There are two or three longitudinal members, for example.

Given that the sachets to be transported may be fitted with access ports and connectors at the top of the sachet, under preferred conditions of implementation of the invention the contention plate incorporates a passage through which the access port or ports on the top of the sachet can pass. The number of orifices corresponds to the number of access port systems on the top of the sachet. The contention plate therefore allows the access ports and any tubes to pass through it, which prevents direct contact of them with the sachet, eliminating the risk of them abrading or rupturing the sachet.

Under other preferred conditions of implementation of the invention, the above contention orifices are provided with an adjustable guillotine for immobilizing the access ports on the top of the sachet. The adjustable guillotine can be adjusted to the dimensions and location of the sachet and, once the system is put into place, can be immobilized by simple means such as a screw perpendicular to the contention plate which is tightened to lock the sliding part or parts of the guillotine to the slides in which they slide.

The contention plate is preferably substantially flat and advantageously has a surface area equal to or greater than 80%, preferably greater than 90%, in particular greater than 95% and more particularly 98% of that of the inside surface delimited by the lateral walls of the rigid container. In this way the clearance between the edges of the contention plate and the sides of the rigid container is very small.

Under preferred conditions of implementation, the contention plate substantially fits the corresponding inside dimensions of the container.

Under other preferred conditions of implementation of the invention, the container can be folded or dismantled. When it can be folded, the container is preferably parallelepiped-shape with lateral walls that remain attached to the bottom wall and fold one over the other. In a variant, two lateral walls, preferably two opposite smaller lateral walls, are removable and can be stowed under or on top of the other two lateral walls, preferably being the larger walls, which remain attached to the bottom wall and can be folded one over the other.

Under other preferred conditions of implementation the above container can be dismantled, for example having three separate lateral faces and the base, the bottom of one lateral face remaining attached to the base, or four separate lateral faces and the base.

Under other preferred conditions of implementation of the invention the bottom of the container is not flat but slightly flared in the upward direction to facilitate flow of the liquid towards the bottom of the sachet at the end of emptying.

Under other preferred conditions of implementation of the invention the bottom of the container includes at least one orifice, preferably near the middle, for correct centering of the sachet relative to the container. Accordingly, in the case of a non-cylindrical sachet, this orifice has any preferred shape other than round, such as elongate oval, triangular, square, hexagonal, etc which, by cooperating with a complementary shape and correspondingly located protuberance on the bottom of the sachet, correctly centers the latter before filling and at the same time constitutes a point of anchorage to the bottom of the container, so improving transport condition. The orifice can also be used for circulation of fluids if the protuberance on the sachet is the base of a bung, for example a drain bung.

As already explained, the containers of the invention are used with flexible sachets made of plastics materials.

This is why the present invention also consists in a container of the above kind fitted with a sachet for transporting bio-pharmaceutical liquids with a capacity of 50 liters or more, preferably a bellows type sachet, the shape of which is substantially that of a rectangular parallelepiped when the sachet has been filled.

Under other preferred conditions of implementation of the invention the above sachet is advantageously a multilayer single-film sachet.

The multilayer single-film sachet is preferably laminated with adhesive, for example a three-layer, in particular four-layer, and especially the PET (Polyester)/PA (Polyamide)/EvOH (Ethylene-Vinyl Alcohol Copolymer)/PE (Polyethylene) type sachet.

The invention will now be described in more detail with reference to the accompanying drawings.

DETAILED DESCRIPTION OF THE PREFERRED EMBODIMENTS

Figure 1:
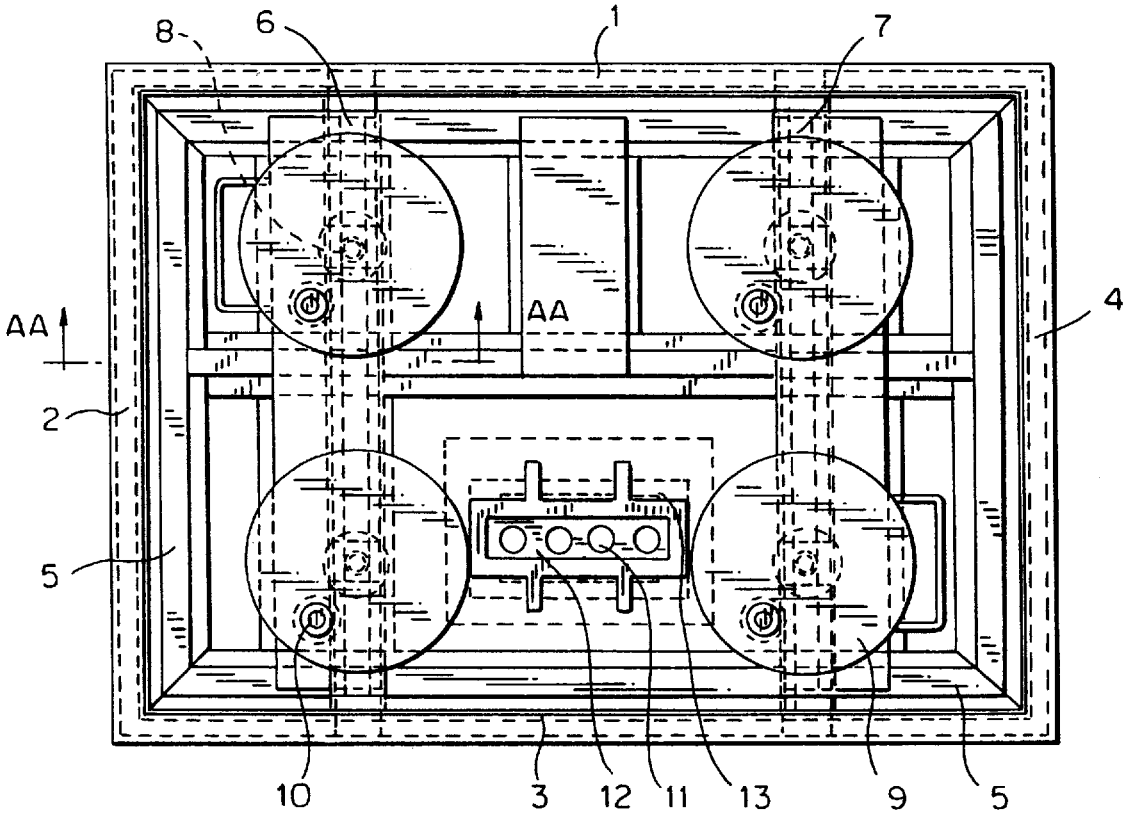
FIG. 1 is a top view of a rigid container in accordance with the invention having a system for continuous adjustment of the pressure of the contention plate on the sachet, bearing on two longitudinal members, said sachet being provided with four access ports side by side at the top.

FIG. 1 shows the lateral walls 1, 2, 3, 4 of a rigid container in accordance with the invention of rectangular parallelepiped shape. A contention plate 5 occupies more than 98% of the available area between the lateral walls 1, 2, 3, 4. Two longitudinal members 6, 7 are parallel to each other, to the bottom 20 and to the upper part of the container and to the lateral walls 2 and 4. The ends of the longitudinal members 6, 7 are inserted in slots in the opposite larger walls 1, 3 of the container. Each longitudinal member 6, 7 includes two screwthreads 21 into which a vertical contention screw 8 can be screwed in a direction perpendicular to said longitudinal member 6, 7. The contention screw 8 has a handle at one end to facilitate turning it. Its other unthreaded end bears on the contention plate 5 and is rotatable in recess 15 of retainer 16 engaged on plate 5. The handle comprises a disk 9 extending around the axis of the screw provided with a grip 10 sliding perpendicularly to the disk 9 of the handle so that the grip 10 is substantially above the disk when screwing in or out and substantially below the disk, as shown here, during transportation. The length of the grip 10 is sufficient to bear against the longitudinal member 7 during transportation. Accidental unscrewing is then impossible because the rotation of the disk of the handle is necessarily less than 180°.

FIG. 1 also shows the bases 11 of four access ports effectively shut off by a guillotine 12, 13 consisting of two parts 12, 13. The two parts 12, 13 of the guillotine have a larger area than the window in the plate through which the access ports exit. They are not guided and are simply installed between the sachet and the contention plate 5, which in the embodiment here allows displacement of the two parts 12, 13 of the guillotine without impediment in the direction parallel to the contention plate 5. A system of the above kind effectively shuts off the ports and minimizes the possibility of jolting at this location. The two parts 12, 13 of the guillotine are installed between the contention plate 5 and a block of foam protecting the sachet.

The tubes and their accessories installed on the access ports are not shown here. Nevertheless the tubes and their accessories clearly cannot under any circumstances rub on the upper part of the sachet which is completely protected by the contention plate 5.

Figure 2:
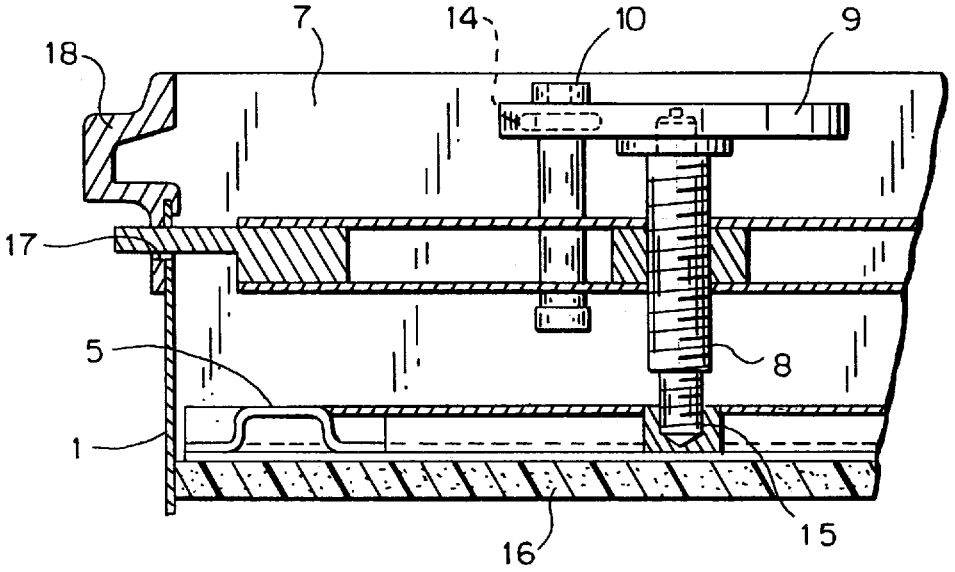
FIG. 2 is a partial sectional view of the rigid container of FIG. 1.

FIG. 2 shows a detail of the adjustment system from FIG. 1. An adjustment screw 8 carries a handle disk 9 at its upper end in which is installed a sliding grip 10 retained by an O-ring 14. The other end of the screw 8 bears on the bottom of a recess 15 on the top of the contention plate 5. The bottom of the contention plate 5 is provided with a block of foam 16 for better protection of the sachet and the edges of the contention plate are parallel and spaced apart from the lateral walls to avoid damaging the sachet. Slots 17 are provided in the lateral walls 1, 3 of the container for inserting the ends of the longitudinal members 6, 7 into it. The container also having a lid 18.

Figure 3:
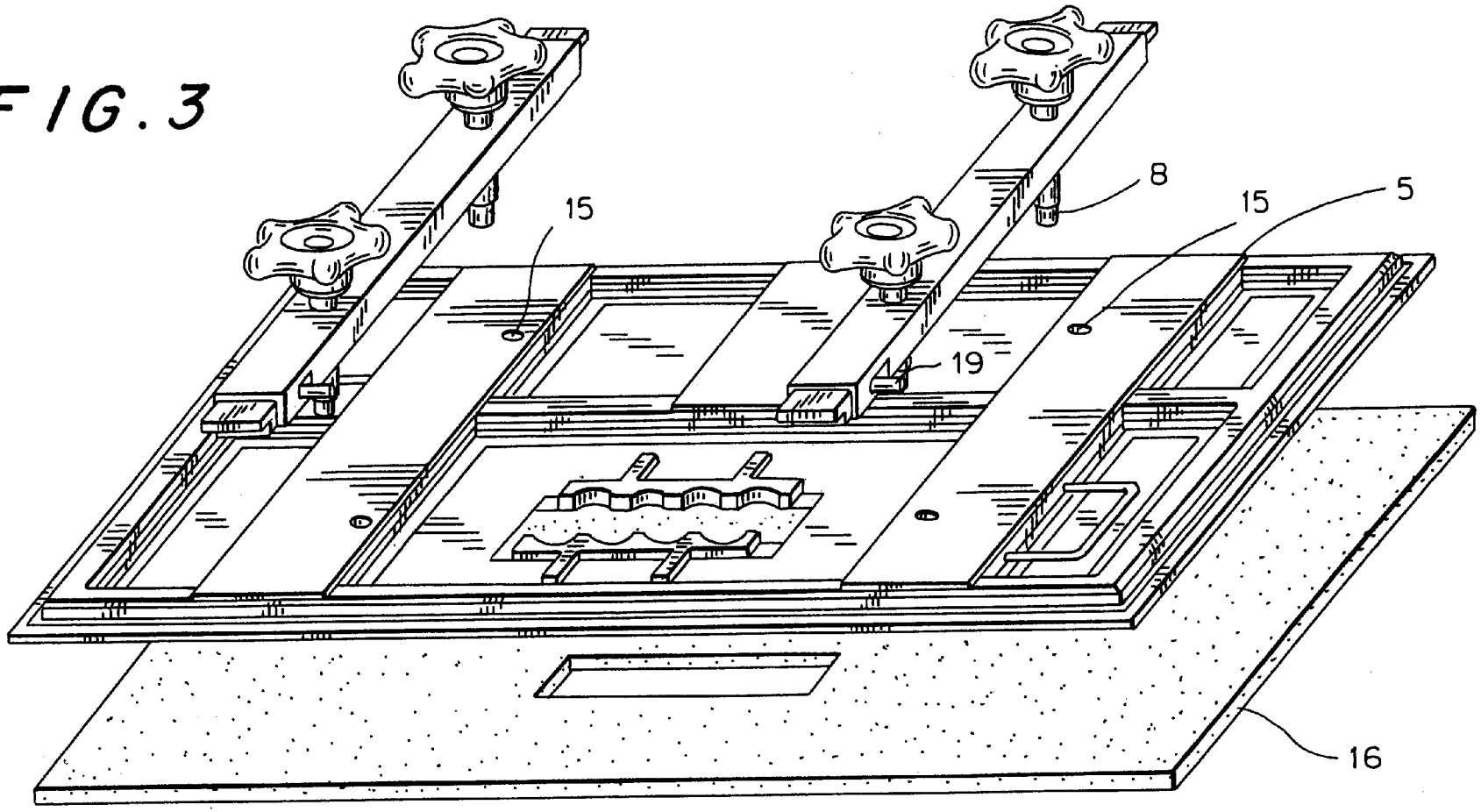
FIG. 3 represents a perspective view of FIG. 1 showing a variant of the system for actuating the screw.

FIG. 3 shows the handles replaced by knobs. Accidental unscrewing is prevented by the use of deformable washers. Note also the block of foam 16, is approximately 15 mm thick, and levers 19 on ends of the longitudinal member 6, 7 for inserting into the slots 17.

Referring to FIG. 2, the procedure for effectively immobilizing a bellows type sachet which is shaped in rectangular parallel piped form installed in the container is as follows:

With the screw 8 in the raised position, the longitudinal members 6, 7 are installed by inserting their ends in a slot 17 in the lateral walls 1, 3 of the container. Using the grips 10, which are fitted in the raised position, not that shown in the figure, each screw actuator 8 is then screwed down until it contacts the bottom of the recesses 15 in the contention plate 5, which applies pressure to the sachet. The two parts 12, 13 of the guillotine are then adjusted by sliding them into the position shutting off the access ports. The final pressure is then established and equalized as required. When this adjustment has been done the grips 10 are lowered into the position in FIG. 2 to prevent accidental unscrewing of the screw actuator 8. In the version shown in FIG. 3 deformable washers are used to protect against accidental unscrewing; the screw is screwed fully home until the knob is immobilized against the longitudinal member. FIG. 2 shows only one slot 17 in the lateral wall 1 of the container. Nevertheless, in order to be able to use the device in accordance with the invention for sachets of different heights, a number of stacked slots can be provided to suit all possible dimensions.

What is claimed is:

1. A rigid container for transporting a plurality of flexible sachets of bio-pharmaceutical fluid, said rigid container comprising:

a bottom wall;

at least two opposite flat lateral walls separably engaged to said bottom wall;

an inner volume between said flat lateral walls of at least fifty liter;

longitudinal members engaged between said flat lateral walls at a top of said rigid container;

a flat sachet contention plate having edges parallel to and spaced apart from said flat lateral walls; and sachet adjustment means engaged between said longitudinal members and said flat sachet contention plate for adjusting a height of said flat sachet contention plate relative to a height of said rigid container to compress said plurality of flexible sachets against said bottom wall when housed in said rigid container;

wherein said flat contention plate has at least one orifice serving as access ports tor passage of connectors at a top of said plurality of flexible sachets.

2. The container according to claim 1, wherein said flat sachet contention plate is continuously adjustable for compression of said plurality of flexible sachets.

3. The container according to claim 1, wherein the sachet adjustment means have a screw actuator system engaged between said longitudinal members and said sachet contention plate to adjust the height of said flat sachet contention plate when compressing said sachets.

4. The container according to claim 3 wherein said screw actuator system comprises at least one threaded hole through each of said longitudinal members, a rod having threads corresponding to the threads of said through hole engaged in each said through hole and recesses in said flat sachet contention plate, each said rod having a handle disk with a grip transversely and slideably engaged to the handle disk at a first end of the rod and an unthread end portion at a second end of the rod, said unthread end portion rotatably engaged in each of said recesses.

5. The container according to claim 4, wherein said rigid container has a lid, said grip being slideable on said disk below a top edge of said lid after a said screw actuator system has adjusted the height of the flat sachet contention plate to compress said sachets.

6. The container according to claim 1, wherein said longitudinal members are removably engaged between said flat lateral walls.

7. The container according to claim 1, wherein said orifice has an adjustable guillotine closure for shutting off said access ports.

8. The container according to claim 1, wherein an area of said flat sachet contention plate is at least ninety percent of that of an area delimited by inside faces of said flat lateral walls.

9. The container according to claim 1, being foldable for storage.

10. The container according to claim 1, being separable for storage.

11. The container according to claim 1, wherein said flat lateral walls have slots;

ends of said longitudinal members being respectively engaged in slots.

* * * * *